US007900289B2

(12) United States Patent
Landsberger et al.

(10) Patent No.: US 7,900,289 B2
(45) Date of Patent: Mar. 8, 2011

(54) MAGNETIC SINK STRAINER

(75) Inventors: David Landsberger, Caldwell, NJ (US); Francis Gomes, Lincoln Park, NJ (US); Morton Milden, West Orange, NJ (US)

(73) Assignee: Bel-Art Products, Pequannock, NJ (US)

( * ) Notice: Subject to any disclaimer, the term of this patent is extended or adjusted under 35 U.S.C. 154(b) by 232 days.

(21) Appl. No.: 12/187,489

(22) Filed: Aug. 7, 2008

(65) Prior Publication Data

US 2009/0049594 A1 Feb. 26, 2009

Related U.S. Application Data

(60) Provisional application No. 60/957,470, filed on Aug. 23, 2007.

(51) Int. Cl.
*E03C 1/26* (2006.01)

(52) U.S. Cl. ..... 4/292; 4/286; 4/289; 4/290; 210/222; 210/223; 210/499; 210/497.01

(58) Field of Classification Search ..... 4/671, 679, 4/289, 292, 286, 290; 210/222, 223, 499
See application file for complete search history.

(56) References Cited

U.S. PATENT DOCUMENTS

| | | | | |
|---|---|---|---|---|
| 3,372,807 | A * | 3/1968 | Barnard | 210/94 |
| 3,834,539 | A * | 9/1974 | Thompson | 210/167.32 |
| 4,692,946 | A | 9/1987 | Jurga | |
| 4,692,948 | A * | 9/1987 | Martin | 4/286 |
| 2004/0107489 | A1 * | 6/2004 | Caterina | 4/290 |

* cited by examiner

*Primary Examiner* — Gregory L Huson
*Assistant Examiner* — Lauren Heitzer
(74) *Attorney, Agent, or Firm* — Lowenstein Sandler PC

(57) ABSTRACT

The present invention provides a magnetic sink strainer with at least one magnet securely attached to the strainer, to create a magnetic field. The invention also provides a magnetic sink strainer made of a magnetized material to provide a magnetic field. The magnetic sink strainer is firmly placed over a standard sink drain and functions to capture and retain objects that are attracted by a force as a result of being subjected to the magnetic field. This prevents such objects from accidentally being discarded into the sink drain. The magnetic sink strainer also includes at least one slit to enable fluids and other non-magnetic substances to easily and rapidly flow down to the sink drain.

15 Claims, 11 Drawing Sheets

MAGNETIC SINK STRAINER

CROSS-REFERENCES

This application claims the benefit of U.S. Provisional Application Ser. No. 60/957,470 filed Aug. 23, 2007, entitled, "Magnetic Sink Strainer", the entire content of which is incorporated herein by reference.

FIELD OF THE INVENTION

The present invention relates to sink strainers, more particularly, to a magnetic sink strainer that is capable of attracting and retaining objects that are attracted by a force as a result of being subjected to a magnetic field.

BACKGROUND OF THE INVENTION

Sink Strainers are known in the art to be used in a laboratory environment. Many objects are frequently lost down a sink drain of a lab sink or the like. Specifically, many objects such as stirring bars are routinely lost in labs when they are poured out into the sink, along with the solution being stirred.

Prior U.S. Pat. No. 4,692,948 discloses a sink strainer having a magnet to assist the water in the sink to create a strong sealing action to prevent the leakage of the water from the sink. So, the prior patent also fails to provide a sink strainer that functions to stop the objects that are attracted by a magnetic force from flowing down the drain.

Thus, in order to prevent losing the objects, destroying plumbing and creating unnecessary pollution, there is a need in the art for a sink strainer that would fit into a standard sink drain and magnetically attract and hold only objects that are attracted by a force as a result of being subjected to a magnetic field such as magnetic objects. There is also a need in the art to allow the fluids and other non-magnetic substances to easily drain down the sink drain. Further, there is a need in the art to provide for an inexpensive magnetic sink strainer that functions to prevent the objects that are attracted by a magnetic force from going down the drain while allowing the non-magnetic substances to flow down the sink drain.

SUMMARY OF THE INVENTION

In one embodiment of the present invention, there is provided a sink strainer having a base member, at least one slit and at least one magnetic receiving region coupled to the base member and at least one magnet embedded into said at least magnetic receiving region.

In another embodiment of the present invention, base member of the above-mentioned sink strainer includes a top portion and a bottom portion. The top portion includes the magnetic receiving region having at least one protrusion including at least one aperture therein to accommodate said magnet.

In yet another embodiment of the present invention, the bottom portion of the base member of the above-mentioned sink strainer includes an opening into a hollow body. The bottom portion includes the magnetic receiving region having a slot formed at a periphery of the opening to accommodate the magnet.

In yet another embodiment of the present invention, the above-mentioned sink strainer further comprises at least one leg mounted on the bottom portion to securely fit the strainer into a standard sink drain.

In yet another embodiment of the present invention there is provided a sink strainer having a base member and at least one slit. At least a portion of the base member includes magnetized material.

DETAILED DESCRIPTION OF THE INVENTION

Figure 1A:
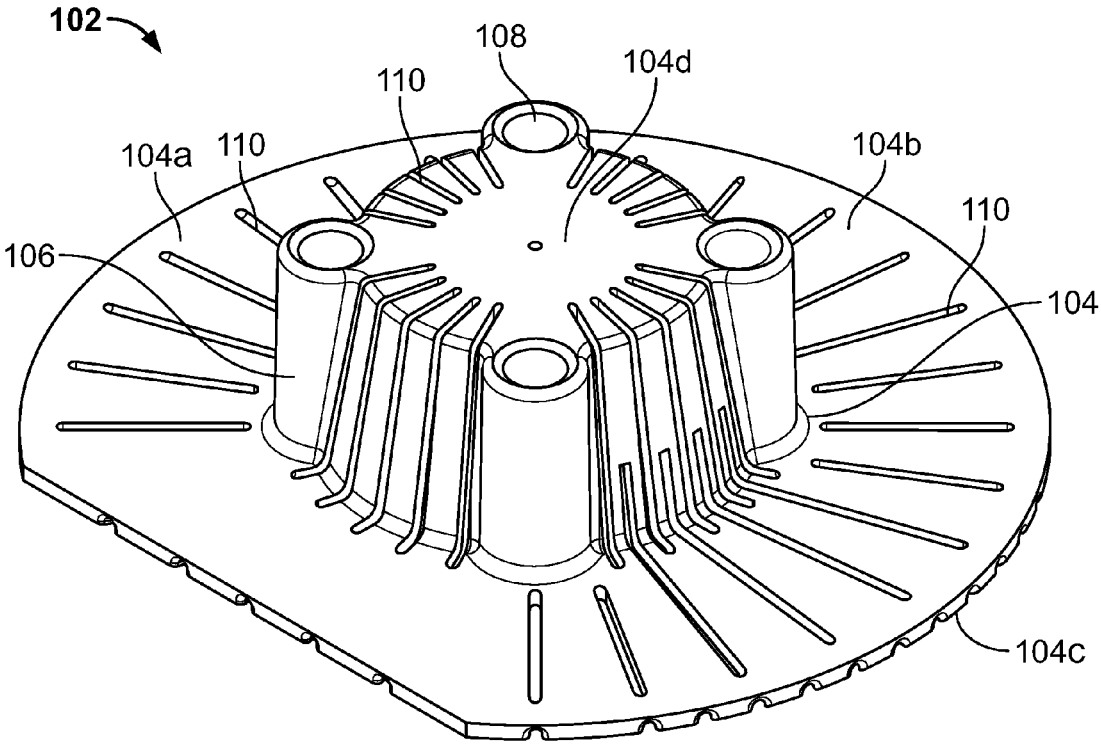
FIG. 1A illustrates a sink strainer in accordance with one embodiment of the present invention.

FIG. 1A illustrates a magnetic sink strainer 102 in accordance with one embodiment of the present invention. The sink strainer 102 includes a base member 104 comprised of a flexible, chemical resistant material such as plastic, for example, Low Density Polyethylene (LDPE). The base member 104 of FIG. 1A is preferably substantially circular in shape and has a flat edge 104*a*. The base member 104 includes an upper portion 104*b* and a bottom portion 104*c*. The upper portion 104*b* further includes an elevated surface 104*d* forming a hollow body 104*e* at the lower portion 104*c* (See FIGS. 1A and 1E) to accommodate various sizes and shapes of sink drains. The flat edge 104*a* allows the strainer 102 to be placed securely near the sink wall. The elevated surface 104*d* preferably includes four substantially cylindrical shaped protrusions 106 integrally attached to each corner of the elevated surface 104*d*, as shown in FIG. 1A. The protrusions 106 further include corresponding apertures 108 to provide for insertion of the magnet into the protrusions 106 as will be described in greater detail below with respect to FIG. 1C.

Even though four protrusions 106 are shown in FIG. 1A, it is obvious to one skilled in the art that the strainer 102 may have more or less than four protrusions 106. Additionally, the protrusions 106 do not have to be cylindrical in shape and may be comprised of other configurations in order to accommodate magnets of various shapes and sizes. The base member 104 also includes slits 110 to allow the liquids and non-magnetic substances to easily and rapidly flow through the strainer 102 into the sink drain. As illustrated in FIG. 1A, the slits 110 are provided throughout the flat edge 104*a* and the elevated surface 104*d* of the base 104.

Figure 1B:
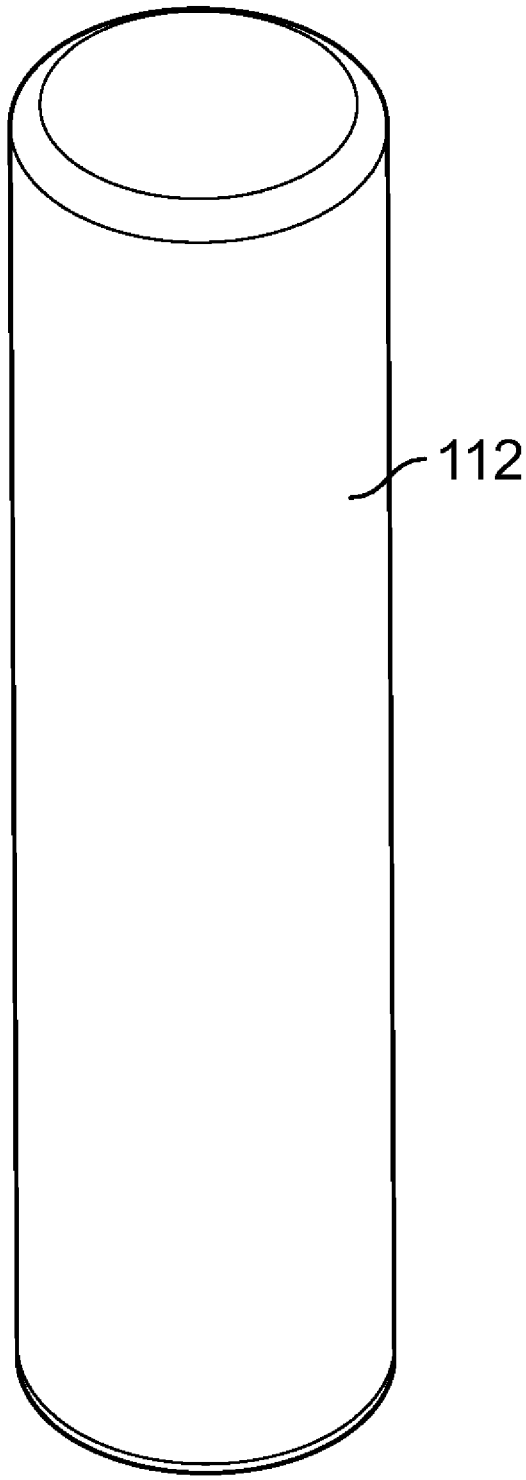
FIG. 1B illustrates an example of a magnet to be inserted into the magnetic sink strainer of FIG. 1A.
Figure 1C:
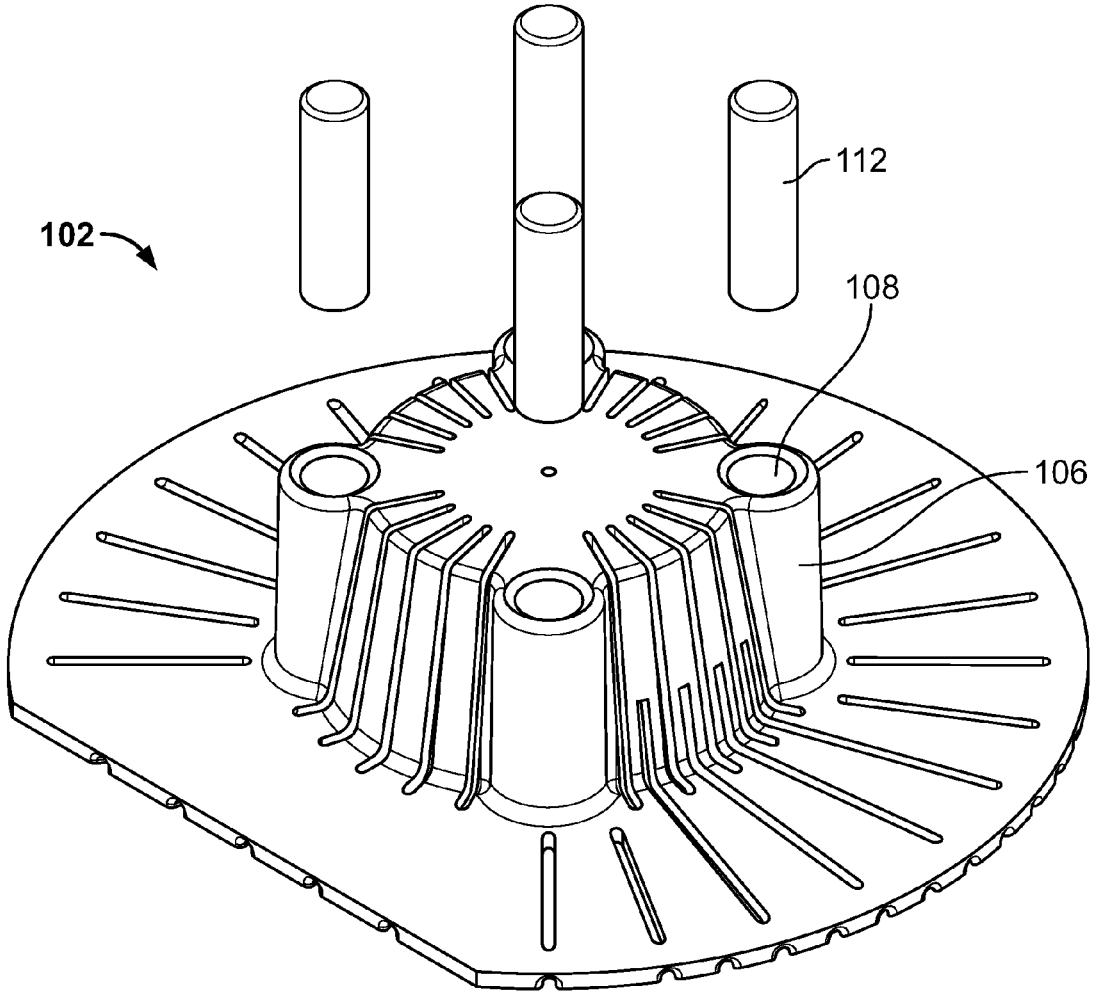
FIG. 1C illustrates the magnets of FIG. 1B being inserted into the sink strainer of FIG. 1A in accordance with the embodiment of the present invention.

FIG. 1B shows a configuration of a magnet 112 shaped and sized to be securely placed into the protrusion 106 via its corresponding aperture 108. Thus, the magnet 112, according to one embodiment, is substantially cylindrical in shape and has the physical dimensions required for firmly placing the magnet into the protrusions 106 as shown in FIG. 1C. FIG. 1C illustrates each of the four magnets 112 positioned to be inserted into each of the four protrusions 106 through their respective apertures 108. The magnets 112 function to capture and retain the objects as is described in greater detail below with respect to FIG. 2.

Figure 1D:
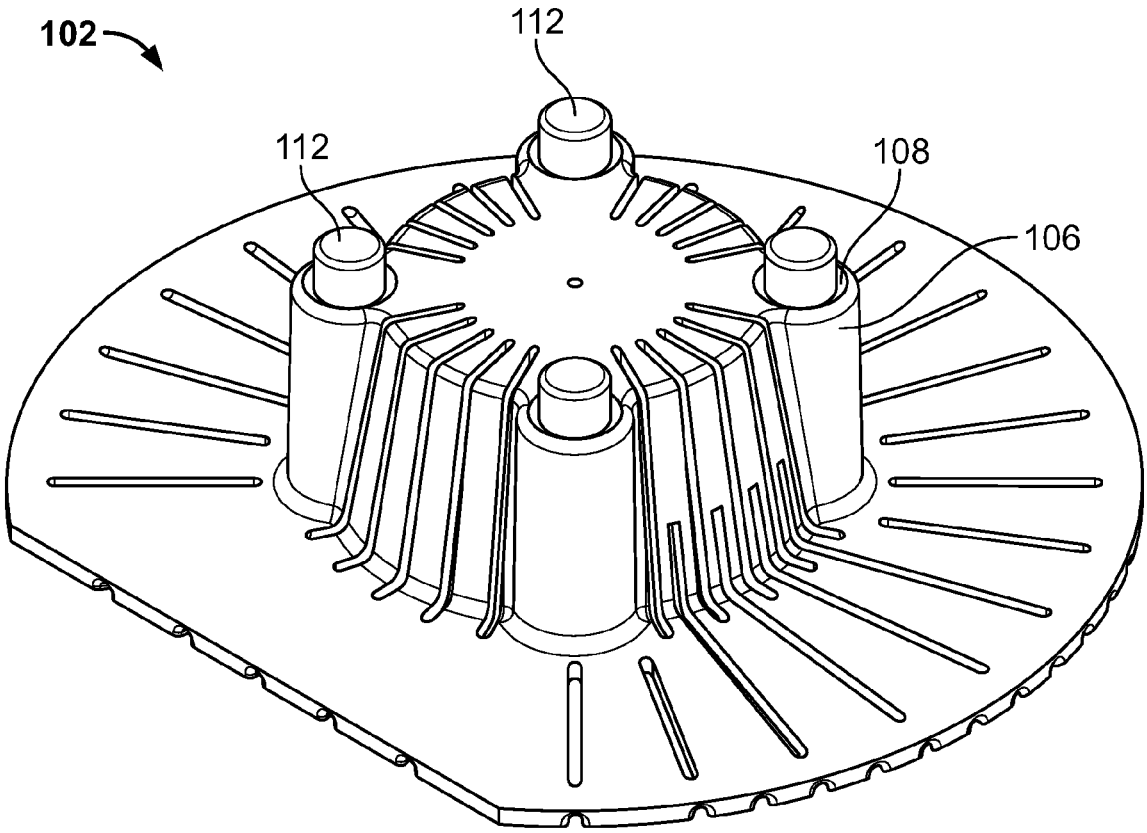
FIG. 1D illustrates a magnetic sink strainer including the magnets of FIG. 1B securely attached to the sink strainer of FIG. 1A.
Figure 1E:
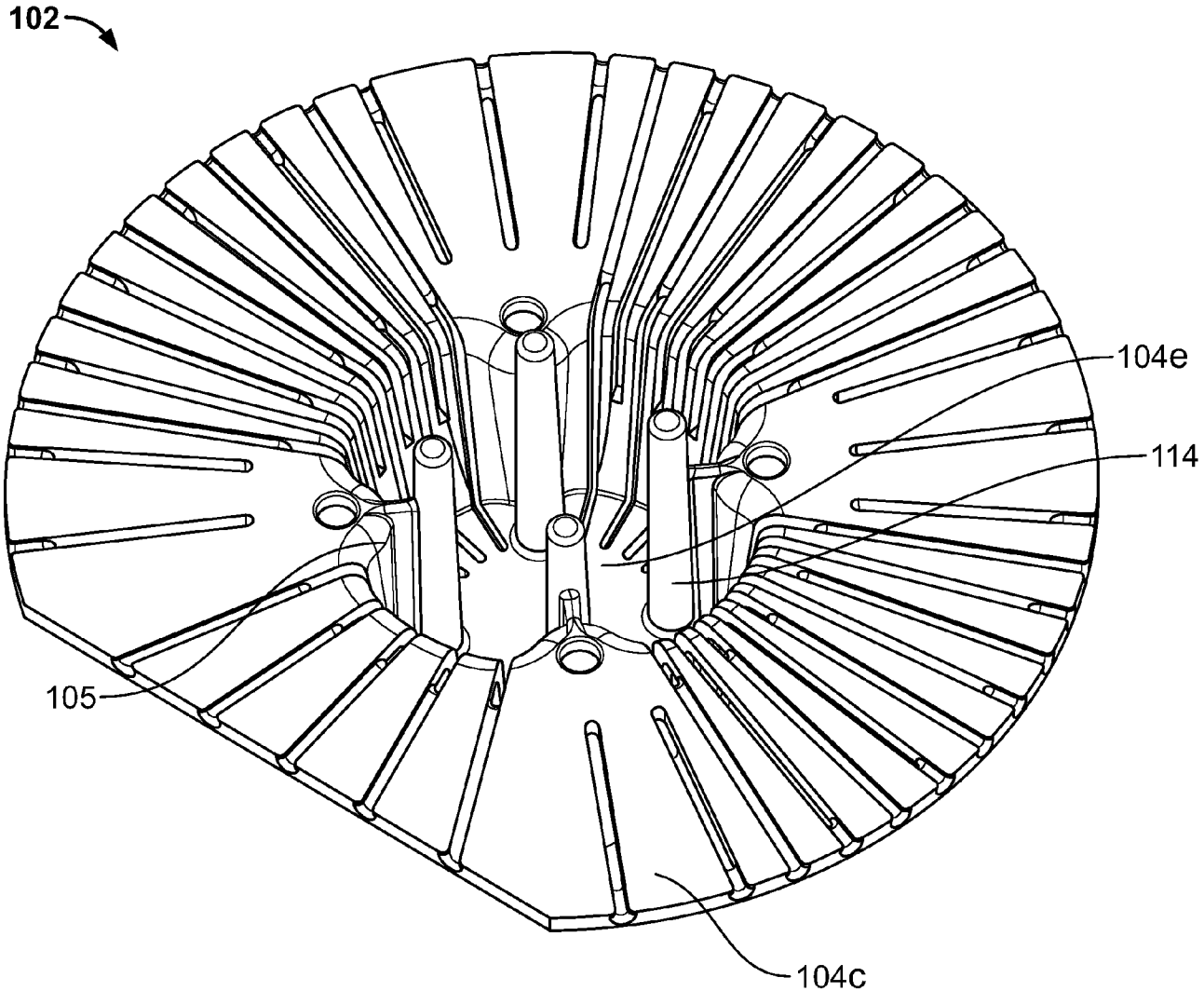
FIG. 1E illustrates a bottom view of the magnetic sink strainer of FIG. 1D in accordance with a preferred method of the present invention.

Referring now to FIG. 1D, there is shown a top portion of the sink strainer 102 with the magnets 112 securely embedded into the protrusions 106 using any known methods, preferably press fitted. In a preferred embodiment as illustrated in FIG. 1D, a small portion of one end of the magnet 112 can be seen projecting from the aperture 108, while the remaining portion of the magnet 112 is enclosed by the protrusion 106. The magnets 112 embedded into the protrusion 106 create a magnetic field strong enough to attract objects on and/or a near the surface of the strainer 102. The objects as described in the present invention are objects attracted by a force as a result of being subjected to the magnetic field such as magnetic objects, ferromagnetic objects, magnets etc. The force is strong enough to attract and retain these objects FIG. 1E shows a bottom portion of the magnetic sink strainer 102 displaying the lower portion 104*c* of the base 104 including an opening 105 into the hollow body 104*e* of the elevated surface 104*d*. In a preferred embodiment of the present invention, a set of four legs 114 are mounted on the lower portion 104*c* extending from the hollow body 104*e* beyond the opening 105 as illustrated in FIG. 1E. The legs 114 function to securely place the strainer 102 on top of a standard sink drain or hole to prevent movement of the strainer 102 beyond the sink drain/hole, especially during receipt of a fluid substance. The legs 114 preferably also act as a barrier to prevent the magnetic object from moving away from the drain. Although the legs 114 shown in FIG. 1E are substantially cylindrical in shape, it is known to one skilled in art that the legs 114 may vary in shape and size and still be placed securely inside any sink hole and prevent the movement of the strainer 102 beyond the sink hole. Even though four legs 114 are shown in FIG. 1E, it is obvious to one in ordinary skill in the art that the strainer may preferably contain more or less than four legs.

The legs 114 described above are not required to be attached to the magnetic strainer 102 of the present invention. The magnetic strainer 102 would serve its purpose to magnetically attract and retain only the objects described above without the presence of the legs 114. However, as discussed above, the legs 114 on the underside of the strainer 102 function to anchor the strainer in the sink drain and further prevent it from being dislodged by flowing liquid.

Figure 2:
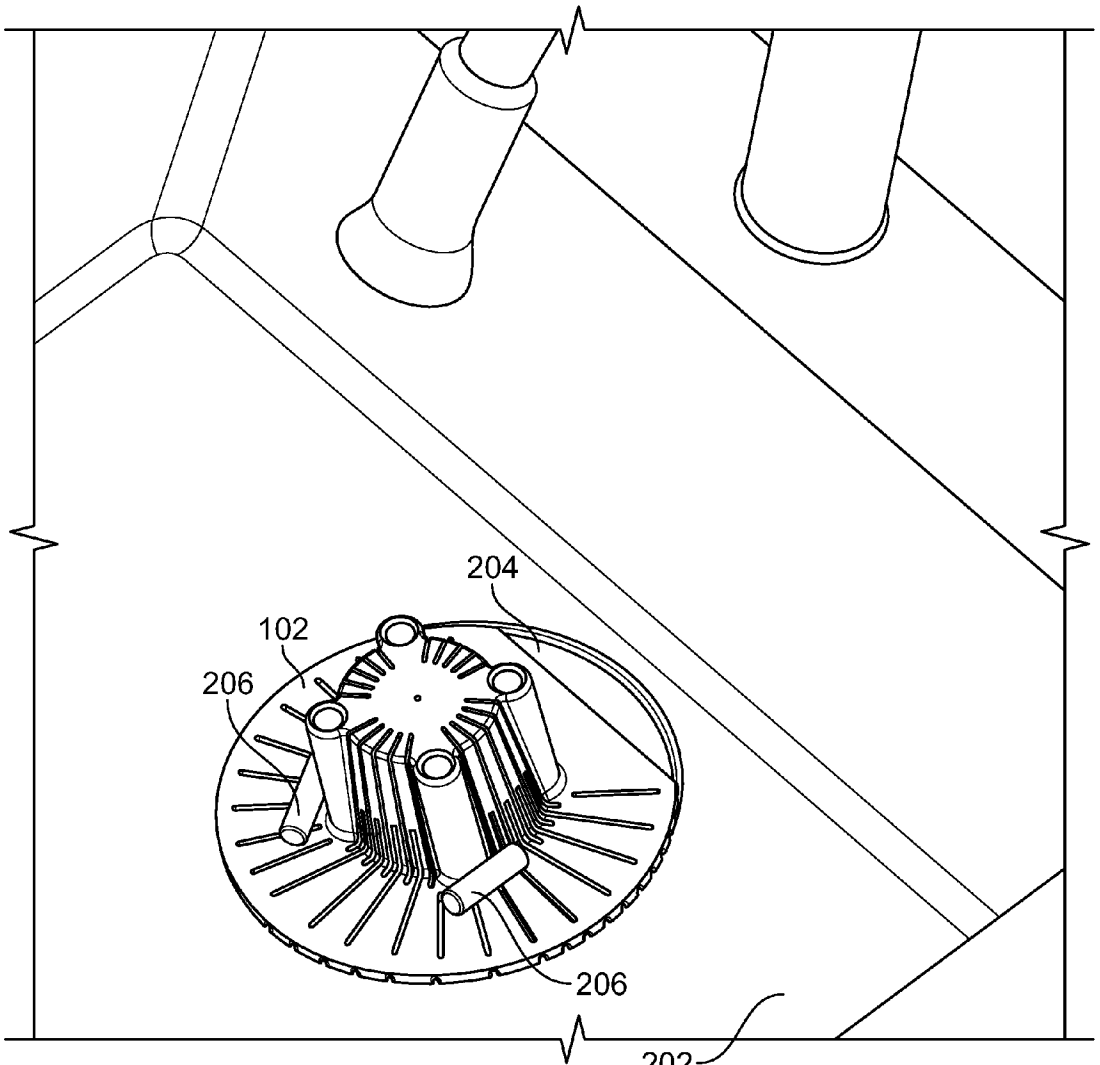
FIG. 2 illustrates placement of the magnetic sink strainer of FIG. 1D on the sink drain.

Referring to FIG. 2, there is shown the magnetic sink strainer 102 placed in a standard sink 202 on top of a sink hole or drain 204 as illustrated in FIG. 2. Although not shown, the legs 112 are preferably inserted into the sink drain 204. The liquids and any non-magnetic substances discarded in the sink 202 will pass through the slits 110 of the strainer 102, which will flow down the sink drain 204. At the same time, object(s) 206 shown in FIG. 2 will be captured by the magnets 112 prior to reaching the drain 204. Object(s) 206 are the objects described above as any object that is attracted by a force as a result of being subjected to a magnetic field.

Each of the magnets 112 creates enough magnetic force around its periphery for the objects 206 to be captured and retained by the strainer 102, as shown in FIG. 2. In this manner, the objects 206 will be prevented from being lost down the drain 204. These objects captured by the strainer 102 can preferably be retrieved later by hand or other means.

Figure 3A:
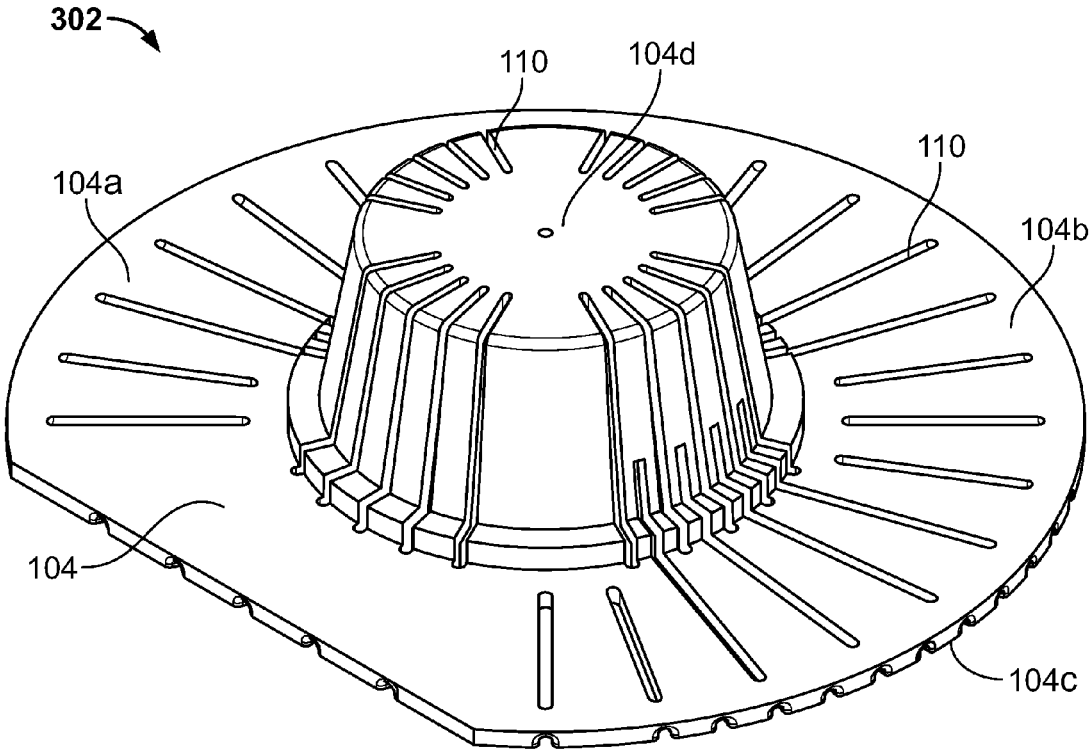
FIG. 3A illustrates a sink strainer in accordance with another embodiment of the present invention.

Referring to FIG. 3A, there is disclosed a magnetic sink strainer 302 in accordance with another embodiment of the present invention. The sink strainer 301 is similar in structure as the strainer 102, but does not contain the protrusions 106 and the corresponding apertures 108.

Figure 3B:
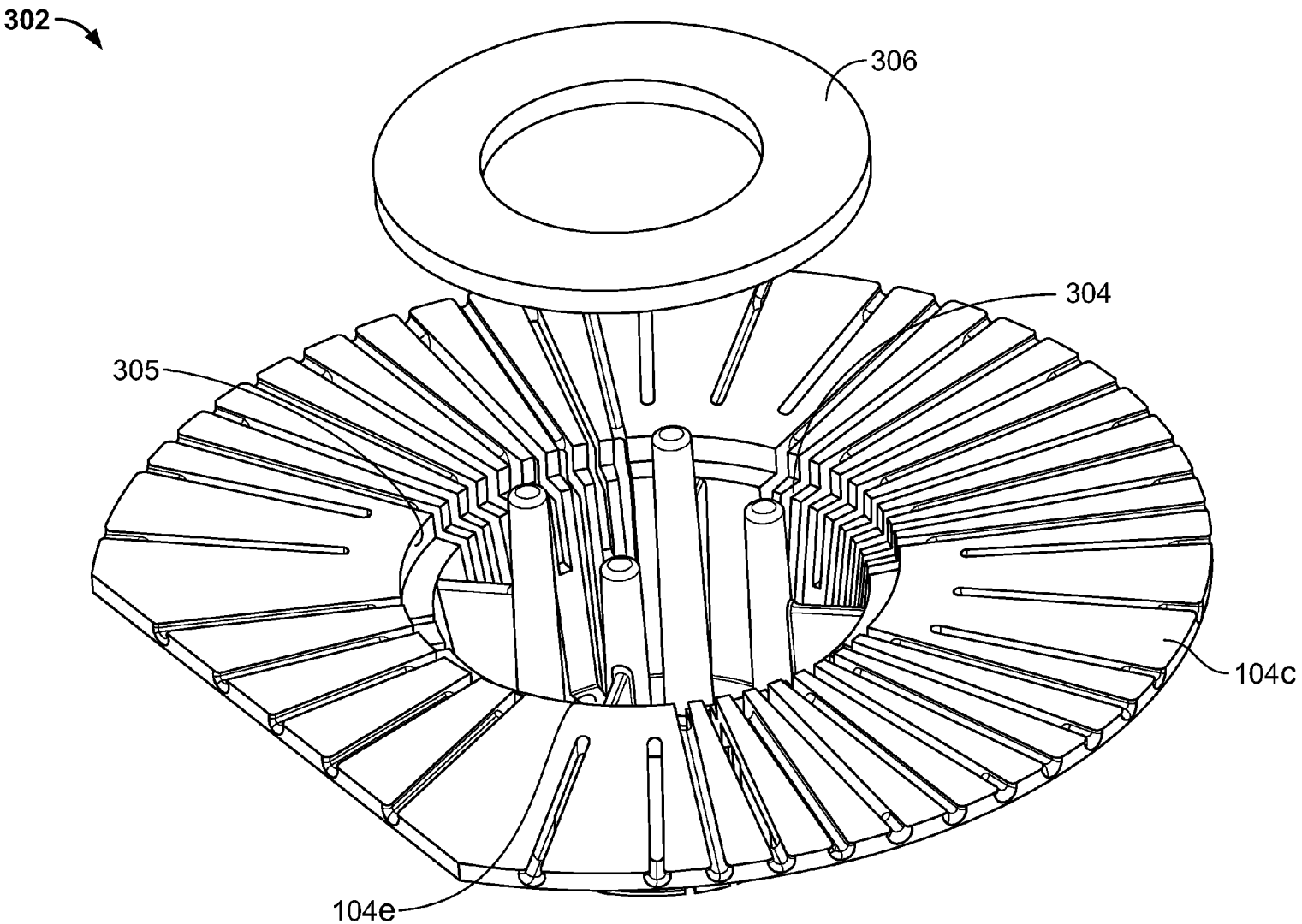
FIG. 3B illustrates a magnet being inserted into the sink strainer of FIG. 3A in accordance with another embodiment of the present invention.
Figure 3C:
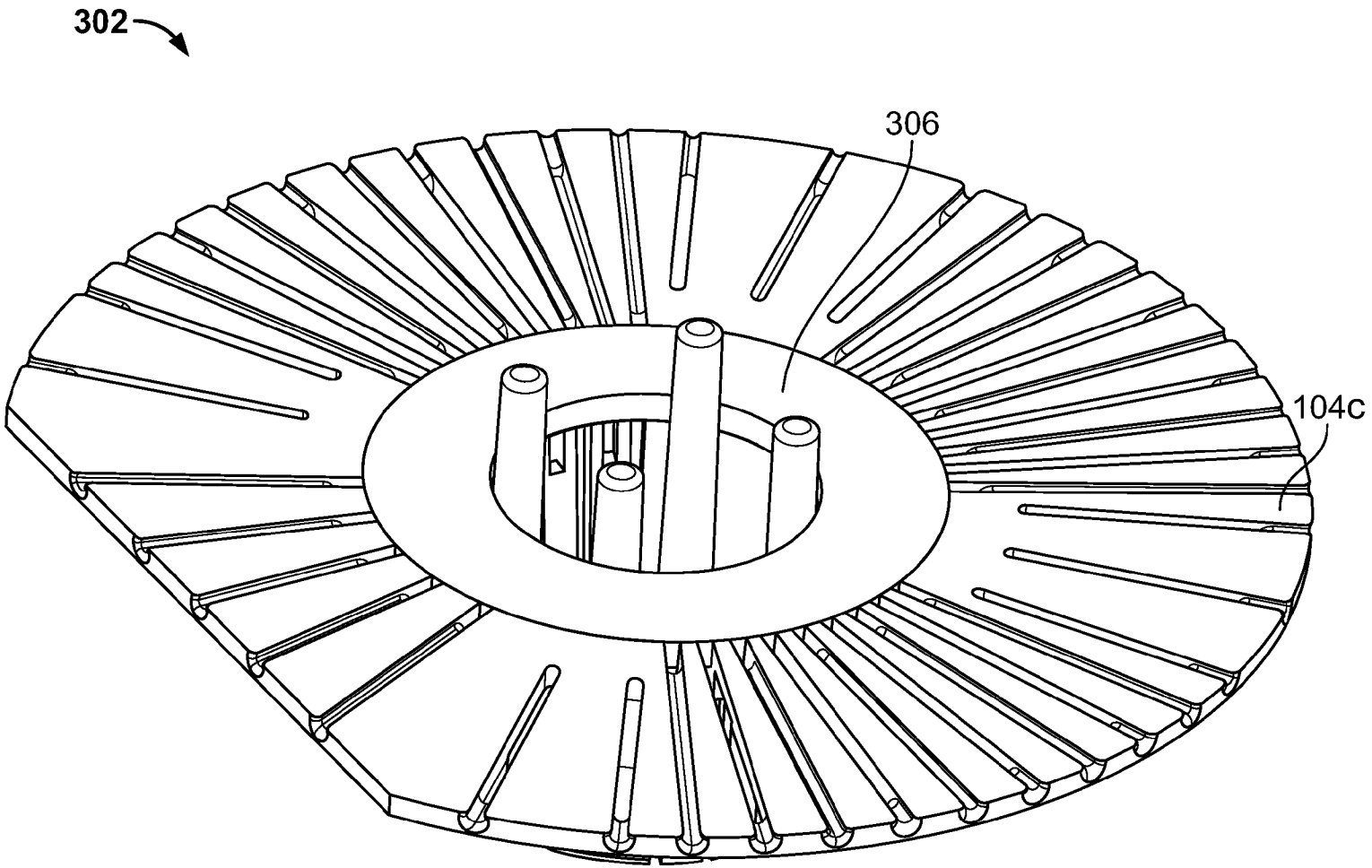
FIG. 3C illustrates a magnetic sink strainer including the magnet of FIG. 3B securely attached to the sink strainer of FIG. 3A.

FIG. 3B illustrates a bottom view of the sink strainer 302 of FIG. 3A. As illustrated in FIG. 3B, the sink strainer 302 preferably comprises a substantially circular slot 304 at the periphery of the circular opening 305 to provide for placement of a disk magnet 306. The disk magnet 306 is preferably shaped and sized to fit firmly in the slot 304 as shown in FIG. 3C using any known methods, preferably press fitted. The disk magnet 306 embedded into the slot 304 creates a magnetic field strong enough to attract the objects on and/or a near the surface of the strainer 302.

Figure 3D:
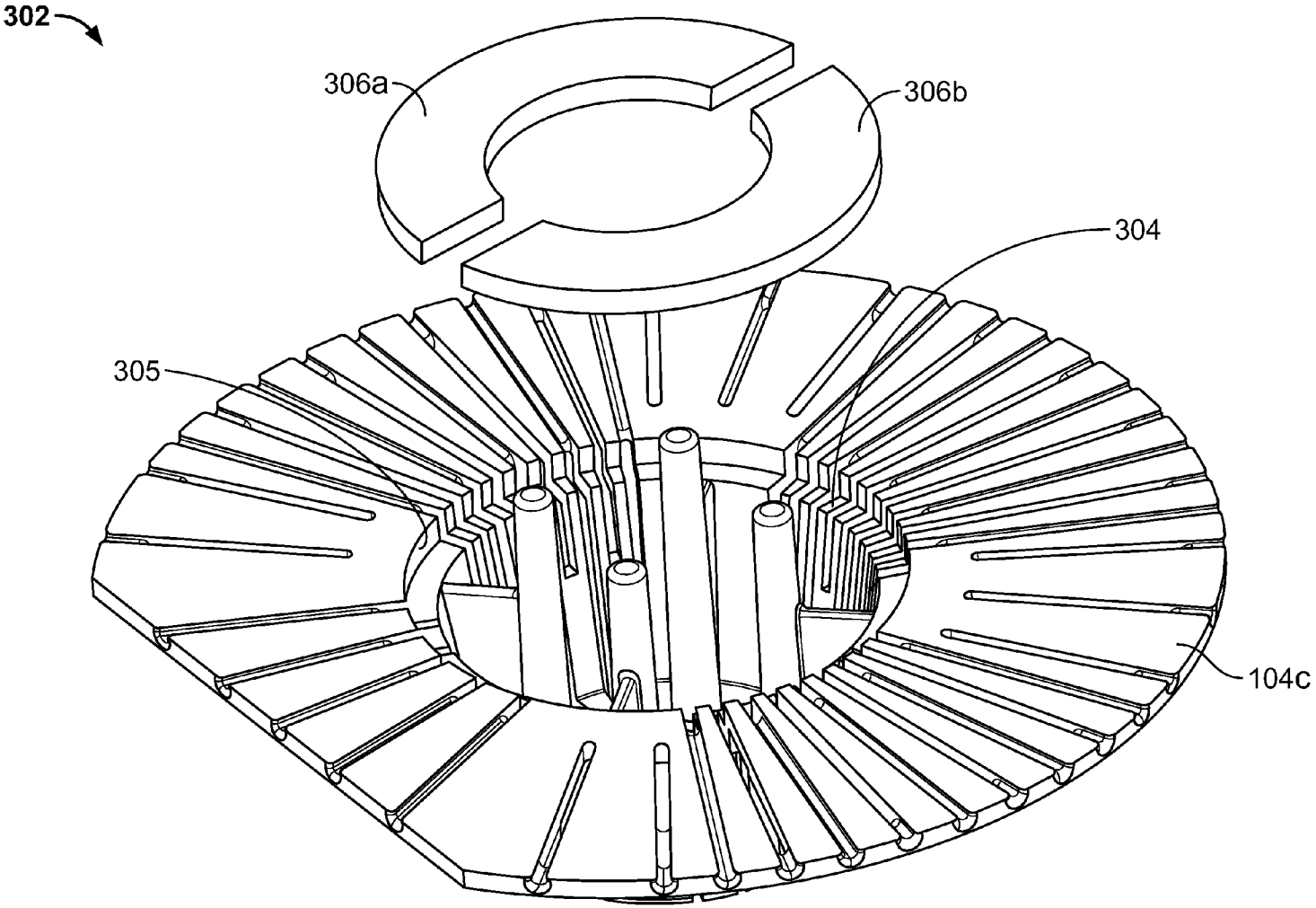
FIG. 3D illustrates a magnet being inserted into the sink strainer of FIG. 3A in accordance with an alternate embodiment of the present invention.
Figure 3E:
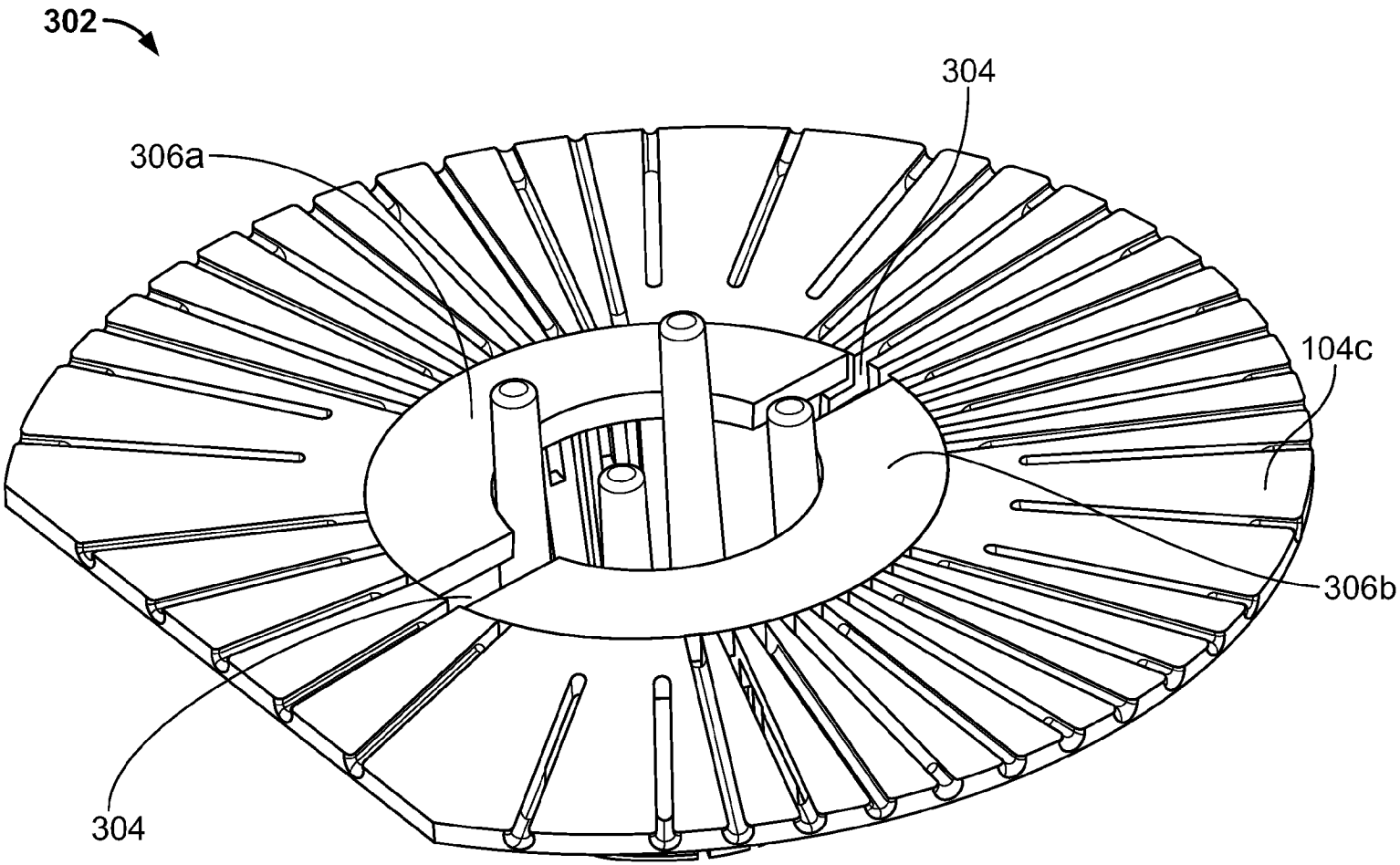
FIG. 3E illustrates a magnetic sink strainer including the magnet of FIG. 3D securely attached to the sink strainer of FIG. 3A.

Referring to FIG. 3D, there is disclosed the magnetic sink strainer 302 comprising a split disk magnet in accordance with an alternate embodiment of the present invention. The disk magnet 306 is segmented preferably in multiple of two magnets 306*a* and 306*b* having substantially semi-circular configuration in accordance with another alternate embodiment of the present invention. The disk magnets 306*a* and 306*b* are placed on the slot 304 leaving opposite ends of the slot 304 exposed, as illustrated in FIG. 3E using any known methods, preferably press fitted. Even though not shown, the slot 304 can alternatively be split into two slots to accommodate the disk magnets 306*a* and 306*b*. Note that the disk magnet 306 can also preferably be divided into more than two magnets.

Even though the slot 304 as illustrated in FIGS. 3B to 3E has a substantially circular configuration, it is obvious to one skilled in the art that the slot 304 may be formed of other configurations to accommodate magnets of various shapes and sizes. Additionally, both the disk magnet 306 and the split disk magnets 306*a* and 306*b* function in a similar manner to the magnets 112 by creating a magnetic force on the strainer 302 to attract and retain the objects.

In an alternate embodiment of the present invention, a magnetic sink strainer (not shown) is similar in structure as the strainer 302 but does not contain the slot 304 and the magnet 306. The magnetic sink strainer of this embodiment is made of flexible magnetic plastic or similar magnetic material. Either the entire strainer may be made of the magnetic material or a portion of the strainer may be made of the magnetic material that is magnetized. In a preferred embodiment, the entire strainer is made of the magnetic material. The magnetic material inherently formed in this strainer creates a magnetic field strong enough to attract the objects on and/or a near the surface of the strainer.

Thus, according to the various embodiments of the present invention, the magnetic sink strainer functions as a trap to retain the objects while allowing liquids and non-magnetic substances to pass through the sink drain. The magnetic sink strainer of the present invention can be used in a variety of sinks including standard lab sinks and the sink drains. Furthermore, the magnetic sink strainer of the present invention is a cost effective solution to prevent the loss of the objects.

Although various embodiments that incorporate the teachings of the present invention have been shown and described in detail herein, those skilled in the art can readily devise many other varied embodiments that still incorporate these teachings without departing from the spirit and the scope of the invention.

The invention claimed is:

1. A sink strainer sized to fit on a drain of a sink to allow liquids to pass while retaining objects said strainer comprising:

a base member having at least one slit;

at least one magnetic receiving region coupled to the base member; said magnetic receiving region comprising at least one protruding upwardly from the base;

at least one magnet embedded into said protrusion.

2. The sink strainer of claim 1 wherein said magnet functions to attract and retain said at least one objects that is attracted by a force as a result of being subjected to a magnetic field.

3. The sink strainer of claim 1 wherein said slit functions to allow non-magnetic substance to pass through the strainer.

4. The sink strainer of claim 1 wherein said base member comprising a substantially flat edge.

5. The sink strainer of claim 1 wherein said base member is substantially circular in shape.

6. The sink strainer of claim 1 wherein said base member comprise a top portion and a bottom portion.

7. The sink strainer of claim 6 wherein said top portion includes said magnetic receiving region comprising said at least one protrusion having at least one aperture therein to accommodate said magnet.

8. The sink strainer of claim 7 wherein said magnet is shaped and sized to fit into the protrusion.

9. The sink strainer of claim 7 wherein at least a portion of said magnet projects from the protrusion via the aperture.

10. The sink strainer of claim 6 wherein said top portion comprises an elevated portion forming a hollow body.

11. The sink strainer of claim 10 wherein said bottom portion comprising an opening into the hollow body.

12. The sink strainer of claim 10 further comprising at least one leg mounted to the bottom portion such that the at least one leg extends from the hollow body.

13. The sink strainer of claim 12 wherein said leg is shaped and sized to securely fit into a sink drain.

14. The sink strainer of claim 1 wherein said body member comprising plastic material.

15. The sink strainer of claim 1 wherein said body member comprising chemical resistant material.

* * * * *